US008840377B2

(12) United States Patent
Leece et al.

(10) Patent No.: US 8,840,377 B2
(45) Date of Patent: Sep. 23, 2014

(54) FLUID COMPRESSOR AND MOTOR VEHICLE REFUELLING APPARATUS

(75) Inventors: Norman Kay Leece, Welford on Avon (GB); David Ogilvie Crane, Welford on Avon (GB); Alan Brightwell, Welford on Avon (GB); David Alan Dawson, Welford on Avon (GB); Jeffrey Martin Bucksey, Welford on Avon (GB); Neil Graham Johnson, Welford on Avon (GB)

(73) Assignee: Gasfill Limited, Welford on Avon, Warwickshire (GB)

( * ) Notice: Subject to any disclaimer, the term of this patent is extended or adjusted under 35 U.S.C. 154(b) by 963 days.

(21) Appl. No.: 12/279,168

(22) PCT Filed: Feb. 13, 2007

(86) PCT No.: PCT/GB2007/050060

§ 371 (c)(1),
(2), (4) Date: Aug. 12, 2008

(87) PCT Pub. No.: WO2007/093826

PCT Pub. Date: Aug. 23, 2007

(65) Prior Publication Data

US 2009/0047144 A1 Feb. 19, 2009

(30) Foreign Application Priority Data

Feb. 16, 2006 (GB) ..... 0603117.3

(51) Int. Cl.

| | |
|---|---|
| ***F04B 25/00*** | (2006.01) |
| ***F04B 3/00*** | (2006.01) |
| ***F04B 5/00*** | (2006.01) |
| ***F04B 5/02*** | (2006.01) |
| ***F04B 25/04*** | (2006.01) |
| ***F04B 9/113*** | (2006.01) |

(52) U.S. Cl.

CPC ..... *F04B 5/02* (2013.01); *F04B 25/005* (2013.01); *F04B 25/04* (2013.01); *F04B 9/113* (2013.01)

USPC ..... 417/266

(58) Field of Classification Search

USPC ..... 417/225, 266, 244, 487, 267, 268, 486, 417/491, 525, 533, 269, 530, 254

See application file for complete search history.

(56) References Cited

U.S. PATENT DOCUMENTS

| | | | |
|---|---|---|---|
| 2,007,305 | A | 7/1935 | Pescara |
| 2,387,603 | A | 10/1945 | Neugebauer |

(Continued)

FOREIGN PATENT DOCUMENTS

| | | | |
|---|---|---|---|
| SU | 1583650 | A1 | 8/1990 |
| WO | PCT/GB02/05570 | A1 | 6/2003 |

(Continued)

*Primary Examiner* — Devon Kramer
*Assistant Examiner* — Amene Bayou
(74) *Attorney, Agent, or Firm* — John Timothy Headley

(57) ABSTRACT

A fluid compressor 10 comprising a stator 22, having a bore shaped first chamber 26 and an annular second chamber 30, and a piston 18 comprising a central piston rod 36 having a first piston head 44 and a concentrically arranged cylindrical piston sleeve 38 having a second piston head 48. The stator 22 and piston 18 together define a first compression chamber 12, a second compression chamber 14 provided concentrically around the first chamber 12, and a third compression chamber 16 provided concentrically around the first chamber 12 and linearly with the second chamber 14. The compression chambers 12, 14, 16 are interconnected via intercooling conduits 72, 74. A hydraulic actuator 20 is coupled to the piston 18 by a hydraulic ram 82. During left to right movement of the piston 18 fluid enters the third chamber 16 and fluid is compressed in the second chamber 14.

24 Claims, 6 Drawing Sheets

(56) References Cited

U.S. PATENT DOCUMENTS

| | | | | | |
|---|---|---|---|---|---|
| 3,379,043 | A | * | 4/1968 | Fuchs | 72/56 |
| 3,713,755 | A | * | 1/1973 | Scheffer | 417/258 |
| 4,096,835 | A | | 6/1978 | Lamont | |
| 4,173,433 | A | | 11/1979 | Anderson | |
| 4,334,833 | A | * | 6/1982 | Gozzi | 417/258 |
| 4,369,633 | A | * | 1/1983 | Snyder | 62/117 |
| 4,478,556 | A | * | 10/1984 | Gozzi | 417/256 |
| 4,832,578 | A | * | 5/1989 | Putt | 417/266 |
| 5,290,142 | A | * | 3/1994 | Ispas et al. | 415/1 |
| 5,863,186 | A | * | 1/1999 | Green et al. | 417/53 |
| 5,997,256 | A | * | 12/1999 | Gunther | 417/259 |
| 6,027,319 | A | * | 2/2000 | Winefordner et al. | 417/440 |
| 6,077,053 | A | * | 6/2000 | Fujikawa et al. | 417/399 |
| 6,371,741 | B1 | * | 4/2002 | Wu | 417/446 |
| 6,428,290 | B1 | * | 8/2002 | Wang | 417/468 |
| 6,695,595 | B2 | * | 2/2004 | Wu | 417/530 |
| 2003/0003006 | A1 | | 1/2003 | Axelsson | |

FOREIGN PATENT DOCUMENTS

| | | | |
|---|---|---|---|
| WO | WO 03/052270 | A1 | 6/2003 |
| WO | WO 2004/031643 | A | 4/2004 |

* cited by examiner

FLUID COMPRESSOR AND MOTOR VEHICLE REFUELLING APPARATUS

CLAIM OF PRIORITY

This Application claims the benefit of priority under 35 USC §365 of International Patent Application Serial No. PCT/GB2007/050060 filed on Feb. 13, 2007, designating the United States of America, which in turn claims the benefit of priority under 35 USC §119 of United Kingdom Patent Application Serial No. GB0603117.3 filed on Feb. 16, 2006.

FIELD OF THE INVENTION

The invention relates to a fluid compressor and to motor vehicle refuelling apparatus incorporating the fluid compressor.

An increasing number of motor vehicles are available which use compressed natural gas (CNG) or hydrogen as fuel. As with conventional petrol or diesel vehicles, compressed gas fuelled vehicles need to be regularly refuelled, but the number of refuelling stations providing CNG are few and far between in comparison with the number of petrol stations, and there are only a handful of hydrogen refuelling stations in existence. Using compressed gas fuelled vehicles is therefore currently seen as being inconvenient and impractical.

One solution to the lack of compressed gas refuelling stations that has been put forward is the provision of residentially located compressors that compress natural gas and deliver it direct to the fuel tank of a motor vehicle, such a system is described in WO 2004/031643. No detail of the construction of the gas compressor is provided in WO 2004/031643, but there are many known gas compressors which may be suitable for compressing natural gas, such as those described in U.S. Pat. No. 4,478,556, U.S. Pat. No. 5,782,612, U.S. Pat. No. 4,761,118, and WO 2004/018873. However, known gas compressors generally have high power ratings and require high power, generally 3-phase, electric power supplies, making them unsuitable for residential operation.

SUMMARY OF THE INVENTION

According to a first aspect of the present invention there is provided a fluid compressor comprising:

- a first compression chamber of a first volume;
- a compressed fluid outlet conduit coupled to the first compression chamber;
- a second compression chamber of a second, larger volume provided concentrically around the first compression chamber;
- a piston mounted for linearly reciprocating movement, the piston comprising a first piston head movable to compress fluid within the first compression chamber and a second piston head movable to compress fluid within the second compression chamber; and
- actuation means operable to drive the piston,
- whereby as the piston is driven in a first linear direction fluid enters the second compression chamber and fluid in the first compression chamber is compressed, and as the piston is driven in the opposite direction fluid in the second compression chamber is compressed and compressed fluid from the second compression chamber is delivered to the first compression chamber.

The fluid compressor preferably further comprises a third compression chamber of a third volume, larger than each of the first volume and the second volume, the third compression chamber being provided concentrically around the first compression chamber. Preferably, the third compression chamber is part co-linear with the second compression chamber, the second piston head separating the second and third compression chambers.

The fluid compressor may further comprise at least one additional compression chamber of an intermediate volume, the additional compression chamber being provided concentrically around the first compression chamber and being concentric with at least one of the second and third compression chambers. The piston may further comprises at least one additional piston head movable to compress fluid within the at least one additional compression chamber.

The fluid compressor preferably further comprises a stator defining first and second concentric stator chambers, the piston and the stator together defining the fluid compression chambers. Preferably, the first stator chamber forms the first fluid compression chamber and the second and third compression chambers comprise parts of the second stator chamber defined by the piston and one or more walls of the second stator chamber. The at least one additional compression chamber may be formed between the piston and one or more walls of the first or second stator chambers.

The piston preferably comprises a central piston rod and a concentric piston sleeve, the central piston rod having the first piston head at its distal end and being movably received within the first stator chamber, and the piston sleeve having the second piston head at its distal end and being movably received within the second stator chamber. The second fluid compression chamber preferably comprises the volume of the second stator chamber between the outermost surface of the piston sleeve, the external wall of the second stator chamber and part of one side of the second piston head. The third fluid compression chamber preferably comprises the volume of the second stator chamber between the other side of the second piston head and the walls of the second stator chamber.

The fluid compressor preferably further comprises fluid seals between the piston heads and the respective walls of the stator. The fluid compressor may further comprise fluid seals between the piston rod and the piston sleeve and the respective walls of the stator.

The ratio of the volumes of the compression chambers is preferably selected to provide for substantially the same amount of fluid compression within each compression chamber.

Preferably, each compression chamber is provided with an inlet valve and an outlet valve, the outlet valve of a first compression chamber being coupled to the inlet valve of a subsequent compression chamber by a respective inter-cooling conduit. The inlet and outlet valves are preferably unidirectional valves.

The fluid compressor preferably further comprises a fluid recovery vessel coupled between the compressed fluid outlet conduit and the first compression chamber, the fluid recovery vessel receiving compressed fluid present within the outlet conduit prior to decoupling the outlet conduit from a receiving compressed fluid storage vessel, thereby lowering the fluid pressure within the delivery conduit prior to decoupling.

The actuation means preferably comprises a hydraulic actuator coupled to the piston. The actuation means may alternatively comprise a crank shaft driven by a cam coupled to an electric motor. The electric motor may have a variable drive speed. Alternatively, the cam may be an eccentric cam or a cam having a non-circular profile. The actuation means can preferably be powered from a single phase electrical power supply. The actuation means preferably drives the piston at a cycle rate of approximately 20 cycles per minute.

The fluid compressor preferably further comprises fluid metering means operable to measure the volume of fluid input into the fluid compressor. The fluid metering means preferably comprises piston cycle counting means, a fluid temperature sensor, a fluid pressure sensor, a non-transitory tangible computer readable storage medium operable to store the value of the volumetric capacity of the compression chamber into which fluid to be compressed is delivered from an external fluid supply, and processor means operable to convert the number of piston cycles (being the number of times that the compression chamber is filled with fluid from the external supply) into the volume of fluid delivered from the external fluid supply to the fluid compressor. The processor means is preferably operable to write the volume of fluid delivered to the fluid compressor during a single operation of the fluid compressor to the non-transitory tangible computer readable storage medium, and is preferably further operable to add together the volumes of fluid delivered to the fluid compressor during a plurality of operations of the fluid compressor. The piston cycle counting means preferably comprises a top dead centre position sensor provided at one end of the stator and a bottom dead centre position sensor provided at the other end of the stator.

Preferably, none of the elements of the fluid compressor which come into contact with fluid being processed by the fluid compressor have any lubricants, such as oils, thereby making the fluid compressor free from contamination on its fluid side.

The fluid is preferably a gas, and may be natural gas, nitrogen, hydrogen or air.

According to a second aspect of the invention there is provided motor vehicle compressed natural gas refuelling apparatus comprising:

- a fluid compressor according to the first aspect of the invention provided within a compressor housing;
- a gas inlet conduit coupled at one end to a fluid inlet of the fluid compressor and having connection means at its other end for connection to a natural gas supply; and
- electrical power connection means coupled to the actuation means.

BRIEF DESCRIPTION OF THE DRAWINGS

Embodiments of the invention will now be described in detail, by way of example only, with reference to the accompanying drawings, in which.

DETAILED DESCRIPTION OF THE INVENTION

Figure 1:
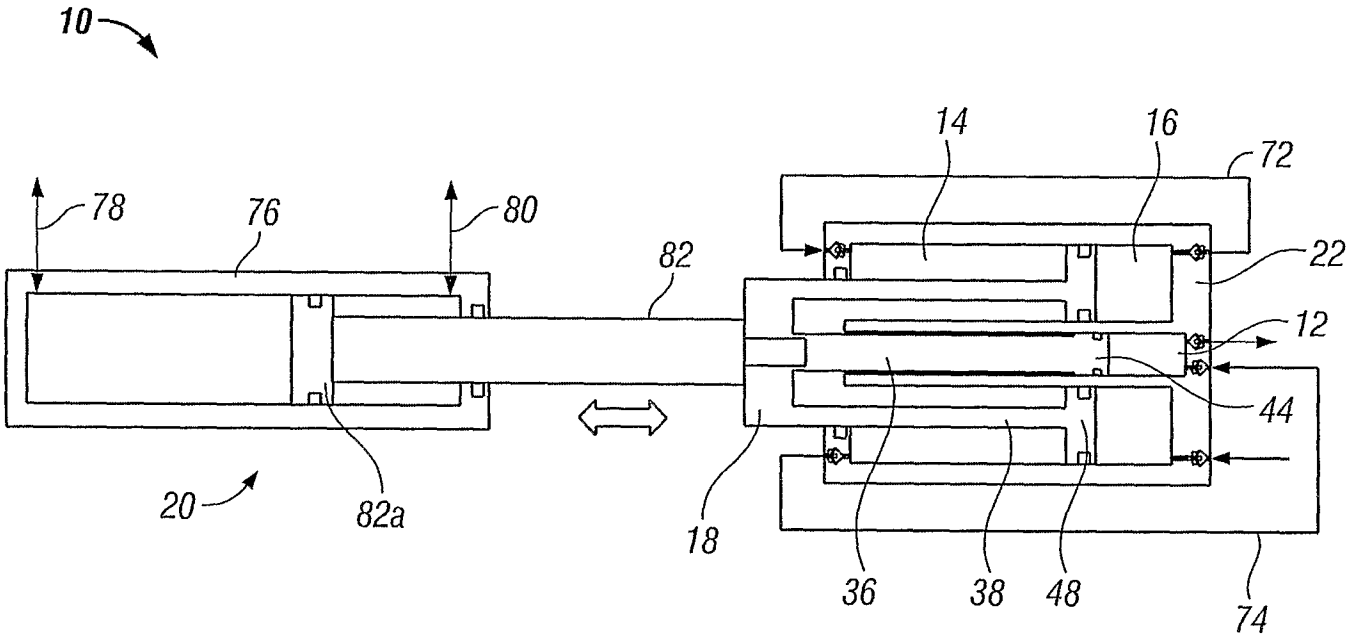
FIG. 1 is a diagrammatic cross-sectional view of a fluid compressor according to a first embodiment of the invention.

Referring to FIGS. 1 to 5, a first embodiment of the invention provides a fluid compressor 10 comprising a first compression chamber 12, a second compression chamber 14, a third compression chamber 16, a piston 18, a hydraulic actuator 20 and a stator 22.

Figure 2:
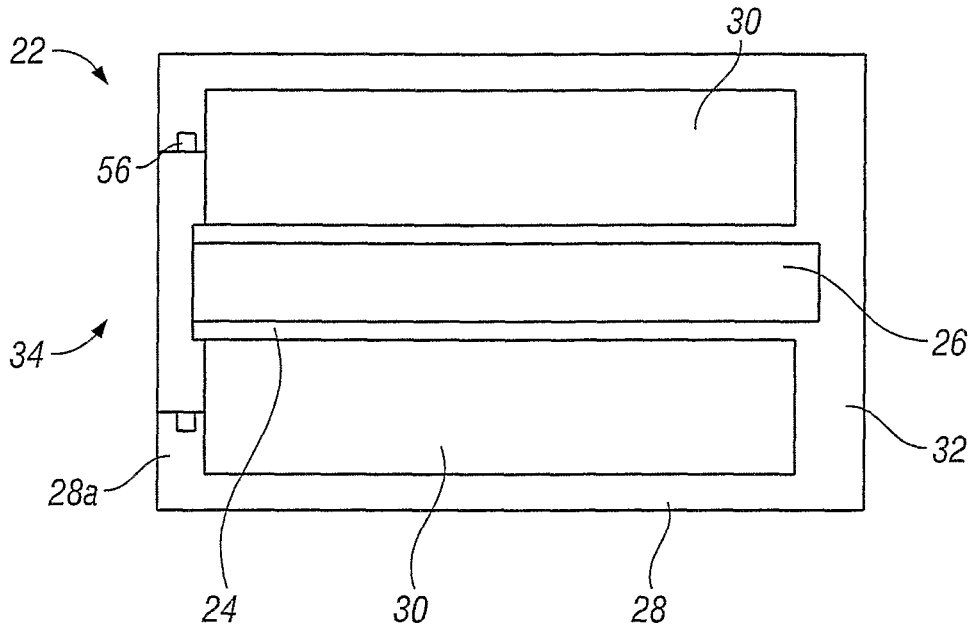
FIG. 2 shows the stator of FIG. 1.

In this example, as shown in FIG. 2, the stator 22 has a cylindrical inner wall 24, which defines a bore shaped first stator chamber 26, and a cylindrical outer wall 28 arranged concentrically around the inner wall 24. Between the inner wall 24 and the outer wall 28 a second, annular stator chamber 30 is defined. An end wall 32 closes the first and second stator chambers 26, 30 at one end. The outer wall 28 extends inwardly at its other end to form a part closure 28*a*, defining an opening 34 through which the piston 18 is received, as will be described in more detail below.

Figure 3:
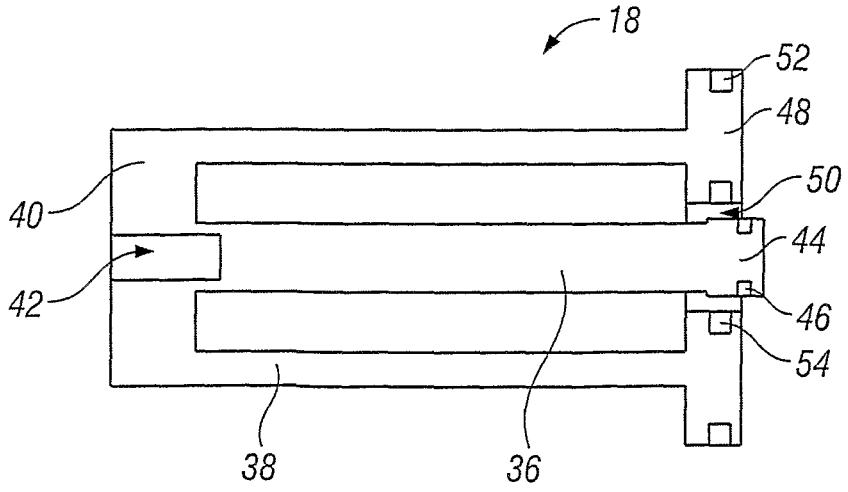
FIG. 3 shows the piston of FIG. 1.

Referring to FIG. 3, the piston 18 comprises a central piston rod 36 and a concentrically arranged cylindrical piston sleeve 38. The rod 36 and the sleeve 38 are interconnected by a coupling piece 40, in which a coupling recess 42 is provided for coupling with the hydraulic ram 20.

A first piston head 44 is provided at the distal end of the piston rod 36. The external diameter of the piston head 44 closely matches the internal diameter of the first stator chamber 26. A PTFE (or PTFE/rubber composite) seal 46 is provided around and within the first piston head 44, to ensure a tight seal is formed between the first piston head 44 and the inner surface of the inner wall 24 of the stator 22.

Figure 4:
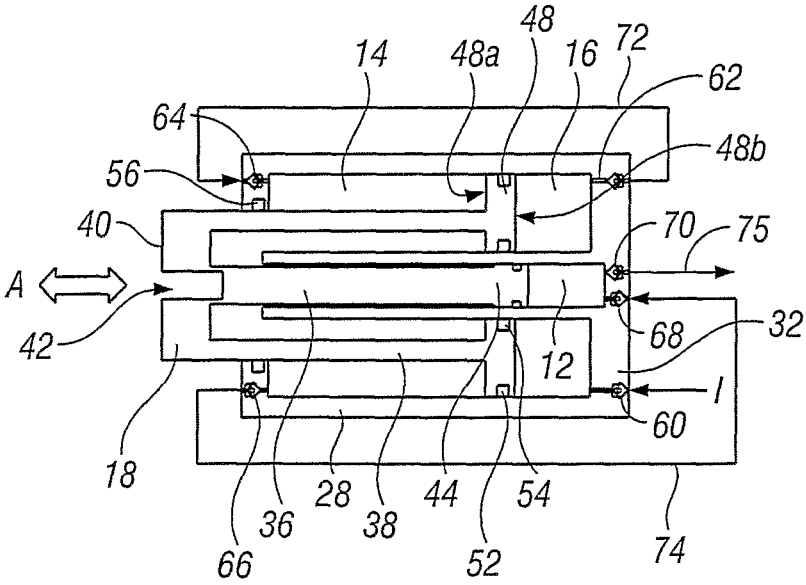
FIG. 4 is an enlarged cross-sectional view of the stator and piston of the fluid compressor of FIG. 1.

A second piston head 48 is provided at the distal end of the piston sleeve 38. The second piston head 48 is ring shaped and extends to either side of the piston sleeve 38. A central aperture 50 is provided in the second piston head 48 through which the first piston head 44 partially extends. PTFE (or rubber) seals 52, 54 are provided around and within external and internal edges of the second piston head 48, to ensure a tight seal is formed between the second piston head 48 and the internal surface of the outer wall 28 of the stator 22 and between the second piston head 48 and the external surface of the inner wall 24 of the stator 22 respectively, as shown in FIG. 4. A PTFE (or PTFE/rubber composite) seal 56 is also provided within the part closure 28*a* of the external wall 28 of the stator 22, for sealing with the external surface of the piston sleeve 38.

Referring to FIGS. 2 and 4, it can be seen that the first stator chamber 26 forms the first compression chamber 12. The second compression chamber 14 comprises that part of the second stator chamber 30 located between the inner surface of the outer stator wall 28, the outer surface of the piston sleeve 38 and the part of the left hand face 48*a* (as shown in FIG. 4) of the second piston head 48 that extends outwardly from the piston sleeve 38. The third compression chamber 16 comprises that part of the second stator chamber 30 located between the end wall 32 of the stator 22 and the right hand face 48*b* (as shown in FIG. 4) of the second piston head 48. It will be appreciated that the relative volumes of the second compression chamber 14 and the third compression chamber 16 will change as the piston 18 reciprocates back and forward (as indicated by arrow A), moving the second piston head 48 through the second stator chamber 30.

The third compression chamber 16 is provided with a one-way inlet valve 60 through which fluid (such as natural gas) is delivered (as indicated by arrow I) into the third compression chamber 16. A one-way outlet valve 62 is also provided for exhausting compressed gas from the third compression chamber 16. The second compression chamber 14 is similarly provided with a one-way inlet valve 64 and a one-way outlet valve 66, and the first compression chamber 12 is also provided with a one-way inlet valve 68 and a one-way outlet valve 70.

The outlet valve 62 of the third compression chamber 16 is connected to the inlet valve 64 of the second compression chamber 14 via a first intercooling conduit 72. The outlet valve 66 of the second compression chamber 14 is connected to the inlet valve 68 of the first compression chamber 12 via a second intercooling conduit 74. The outlet valve 70 of the first compression chamber 12 is coupled to the compressed fluid outlet conduit 75 of the fluid compressor 10.

Referring to FIG. 1, the hydraulic actuator 20 comprises a hydraulic cylinder 76 having inlet/outlet valves 78, 80 and a ram 82 coupled at its distal end to the piston 18 via the coupling recess 42. The hydraulic actuator 20 operates in a manner that will be well known to the person skilled in the art and so its operation will not be described in detail here.

Figure 5:
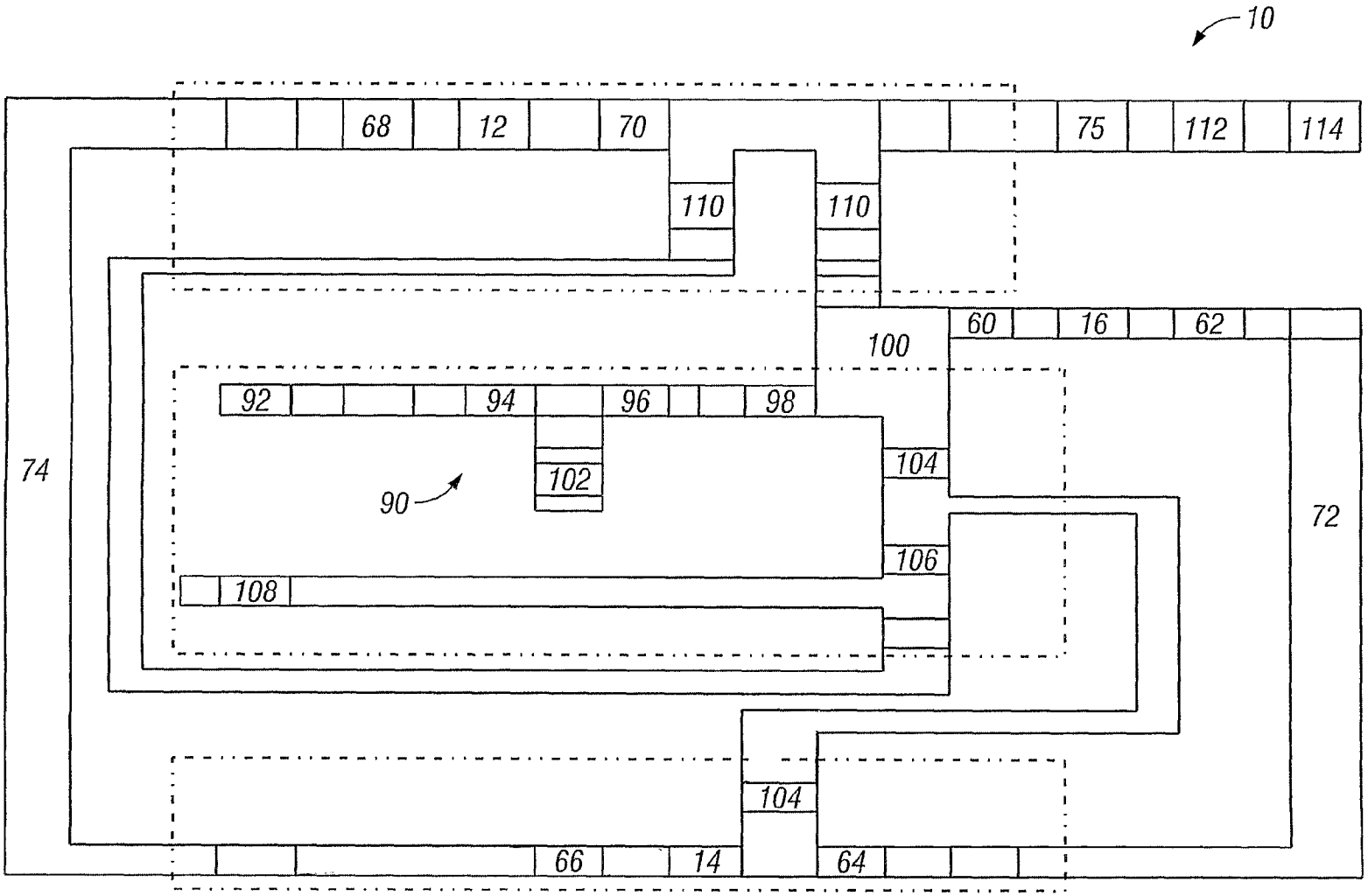
FIG. 5 is a schematic representation of the fluid pathways of the fluid compressor of FIG. 1.

Referring to FIG. 5, the fluid compressor 10 further comprises a fluid inlet pathway 90 comprising (in fluid series) an inlet connector 92, a fluid filter 94, and isolation valve 96, a non-return valve 98 and a gas recovery vessel 100, coupled to the inlet valve 60 of the first compression chamber 16. The filter 94 acts to prevent particles entering the compression chambers 12, 14, 16, thereby preventing incorrect operation of the inlet and outlet valves 60, 62, 64, 66, 68, 70, and general contamination of moving parts and surfaces. The isolation valve 96 is operable to isolate the fluid compressor 10 from an external gas supply (not shown) if required, for example for reasons of safety. A pressure sensor 102 is provided between the filter 94 and the isolation valve 96, operable to measure the pressure of incoming fluid.

Burst discs 104, a burst disc failure detector 106 and an emergency fluid outlet 108 are provided within the fluid compressor 10 to protect the fluid compressor 10 in the event that fluid pressure within the fluid compressor 10 exceeds the normal operating range, for example due to failure of one or more components within the fluid compressor 10. In addition, solenoid offload valves 110 are provided to allow fluid within the fluid compressor 10 to vent to atmosphere in the event of an electrical power failure.

The fluid outlet conduit 75 is provided with a flow restrictor 112 and a breakaway connector 114 at its distal end.

In operation, the starting position (top dead centre: TDC) of a two stroke piston cycle has the ram 82 of the hydraulic actuator 20 and the piston 18 fully to the right (as orientated in the drawings) within their respective chambers; the volumes of the first and third compression chambers 12, 16 are essentially zero and the volume of the second compression chamber 14 is at its maximum. As the ram 82 and the piston 18 move to the left, the movement of the second piston head 48 through the third compression chamber 16 causes fluid (for example natural gas) to be sucked (induction) in through the inlet path 90 and the inlet valve 60 into compression chamber 16. The third compression chamber 16 fills with gas as the volume of the chamber 16 progressively increases during the first piston stroke. At the same time, the volume of the second compression chamber 14 progressively decreases and any gas within the second compression chamber 14 will be forced out of the second chamber 14, through the second intercooling conduit 74, into the third compression chamber 16, thereby being compressed from the volume of the second chamber 14 to the smaller volume of the third compression chamber 16.

When the ram 82 and the piston 18 reach the end of the first piston stroke (bottom dead centre: BDC) they are located fully to the left (as orientated in the drawings). At BDC the volumes of the first and third compression chambers 12, 16 are at their maximum and the volume of the second compression chamber 14 is at its minimum.

During the second stroke of the piston cycle, the ram 82 and piston 18 move from BDC to TDC. This forced gas in the third compression chamber 16 out of the third chamber 16, through the first intercooling conduit 72, and into the second compression chamber 14, thereby compressing the gas from the volume of the third chamber 16 to the smaller volume of the second compression chamber 14.

Simultaneously, any gas in the first compression chamber 12, is forced out of the first compression chamber 12 and through the gas outlet conduit 75, the flow restrictor 112 and the breakaway connector 114 into an external gas storage vessel (not shown). The gas is delivered from the first compression chamber 12 at a gas pressure equal to the current gas pressure in the external storage vessel, up to a maximum of 200 bar in this example.

As the volumes of the first and third chambers 12, 16 are decreasing the volume of the second compression chamber 14 is simultaneously increasing back to its maximum. The duration of the complete piston cycle (TDC to BDC to TDC) is approximately 2.9 s.

As the gas flows through the intercooling conduits 72, 74 any heat absorbed by the gas during compression is dissipated, thereby improving the thermal efficiency of compression in the next stage of compression.

None of the above described elements of the fluid compressor 10 which come into contact with fluid being processed have any lubricants, such as oils, provided on them, thereby making the fluid compressor free from contamination by lubricants on its fluid side.

The specifications of the fluid compressor 10 to deliver compressed gas having a pressure of 200 Bar are:

| Compression chamber | 3rd | 2nd | 1st |
|---|---|---|---|
| Bore diameter (mm) | 120 | 120 | 20 |
| Sleeve diameter (mm) | 30 | 110 | |
| Stroke length (mm) | 180 | 180 | 180 |
| Piston Area ($m^2$) | 0.010602 | 0.0018 | 0.0003 |
| Swept Volume (l) | 1.908517 | 0.3251 | 0.0565 |
| Gas Pressures: | | | |
| Inlet pressure (mBarg) | 21 | | |
| Delivery pressure (Barg) | | | 200 |
| Isothermal Stage Pressure (Bara) | 6.292 | 34.797 | 201.013 |
| Gas Gamma | 1.2 | 1.2 | 1 |
| Isentropic Stage Pressure (Bara) | 9.105 | 46.248 | 201.013 |
| Compression Ratio | 8.804 | 5.079 | 4.346 |
| Gas Intake eff | 90.00% | | |
| Gas intake (l at stp) | 1.655 | | |

Where Barg is gauge pressure and Bara is absolute pressure—typically Barg+1.01325.

The hydraulic actuator 20 has a nominal 2:1 ram piston 82*a* pressure ratio. The larger hydraulic ram piston 82*a* area (left side: direction BDC to TDC) drives the piston 18 in the direction left to right, compressing gas within the first and third compression chambers 12, 16, whilst the smaller hydraulic ram piston 82*a* area (right side: drives TDC to BDC) drives the piston 18 in the direction right to left, compressing gas within the second compression chamber 14. By this means, the hydraulic pressure in each direction can be balanced (made the same pressure) to optimise the hydraulic pressures required in order to minimise the hydraulic flows and hence hydraulic losses within the hydraulic actuator 20.

The specifications of the hydraulic actuator 20 are as follows:

| | BDC to TDC | TDC to BDC |
|---|---|---|
| Bore diameter (mm) | 39.5979797 | 39.59798 |
| Sleeve (Drive Rod diameter) (mm) | 0 | 28 |
| Stroke Length (mm) | 180 | 180 |
| Area ($m^2$) | 0.0012315 | 0.000616 |
| Swept Volume (l) | 0.22167078 | 0.110835 |
| | TDC | BDC |
| Hydraulic Pressure (Bara) | 134.459 | 148.185 |
| Hydraulic Flow rate (l/m) | 6.75 | 6.75 |
| Stroke time (s) | 1.97040691 | 0.985203 |
| Peak Power (kW) | 1.51266164 | 1.66708 |

The drive gear pump operates at 2.5 cc and the motor speed is 2700 rpm.

The piston cycle repeats until the pressure of the gas stored in the external storage vessel reaches a predetermined level (typically 200 bar). The compressed gas output flow rate from the fluid compressor 10 is 2.078 $m^3$/hour. Once the external storage vessel is full, a gas pressure sensor within the external storage vessel sends a "full" signal to the fluid compressor 10, causing the hydraulic actuator 20 to stop.

Before the compressed fluid delivery conduit 75 can be decoupled from the external storage vessel it is necessary to remove any pressurised gas from the delivery conduit 75. To do this, the fluid compressor 10 is 'over-run' slightly before shutdown, whilst being isolated from the external gas supply. This allows any gas remaining within the fluid compressor 10 to be processed through the compression chambers 12, 14, 16 and in so doing creates a vacuum in the recovery vessel 100. The vacuum allows pressurised gas present in the delivery conduit 75 to be released into the recovery vessel 100 so that pressure in the delivery conduit 75 can be made safe without venting gas to atmosphere. The delivery conduit 75 can then safely be decoupled from the external storage vessel.

The recovery vessel 100 has a nominal volume of 20 liters, and a further 2 liters recovery volume (being the volume of the third compression chamber 16) are available by parking the fluid compressor 10 at shutdown with the piston 18 at BDC. Without this depressurisation facility, the pressure in the inlet vessel would typically rise to 0.73 Barg (Bar gauge), which is too high for safe uncoupling. Using the recovery vessel 100 depressurisation mechanism, the pressure prior to decoupling typically falls to 35 mBarg which is a safe pressure at which to decouple the delivery conduit 75 and which does not compromise the inlet pressure at the next start up of the fluid compressor 10

The recovery vessel 100 also has a recovery mode during operation of the fluid compressor 10. The recovery vessel 100 acts to smooth out pressure perturbations in the inlet gas pressure supplied to the fluid compressor 10 from the external gas supply caused by the suction of the fluid compressor 10 via the induction stroke of the piston 18 within the third compression chamber 16.

The fluid compressor 10 further comprises a fluid metering system comprising piston cycle counting means in the form of piston position sensors (not shown) operable to detect the position of the piston 18 at TDC and BDC, an incoming gas temperature sensor provided along side the incoming gas pressure sensor 102 and a microcontroller (not shown). The microcontroller is operable to count the number of times the piston 18 is located at TDC and BDC, from which the number of piston cycles can be obtained (by dividing by two), and to multiply the number of piston cycles by the volume of the third compression chamber 16, taking account of the incoming gas pressure and temperature, to obtain the volume of gas delivered into the fluid compressor 10 from the external gas supply during an operation of the fluid compressor 10. The microprocessor is further operable to store the incoming gas volume for a number of operations of the fluid compressor 10 and to sum these volumes to obtain the total volume of gas supplied to the fluid compressor 10 over a period of time.

Figure 6:
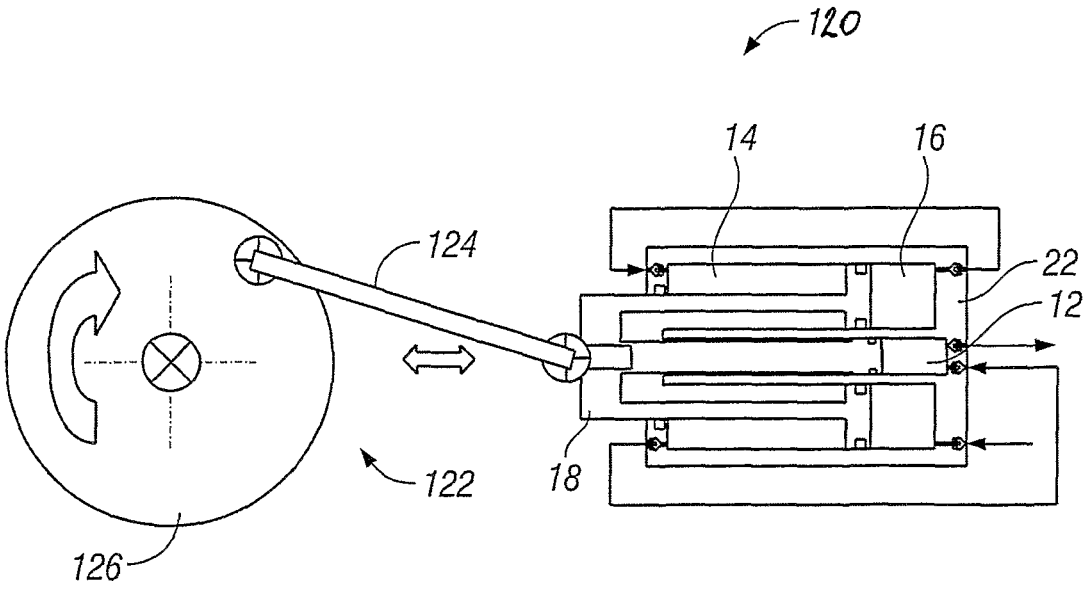
FIG. 6 is a diagrammatic cross-sectional view of a fluid compressor according to a second embodiment of the invention.

A fluid compressor 120 according to a second embodiment of the invention is shown in FIG. 6. The fluid compressor 120 of this embodiment is substantially the same as the fluid compressor 10 of the previous embodiment with the following modifications. The same reference numbers are retained for corresponding features.

In this embodiment the actuation means 122 takes the form of connecting rod 124 driven by a cam 126 coupled to an electric motor (not shown). The distal end of the connecting rod 124 is received within the coupling recess 42 on the piston 18. The connecting rod has a length of 313 mm.

The electric motor is a 120 kW electric motor supplied by a single phase electric power supply. The electric motor is operable at a variable drive speed, in order to limit the peak power requirements which occur when the piston 18 approaches TDC and BDC. The speed of the motor driving the connecting rod 124 is primarily adjusted to limit the peak motor power so as to enable the fluid compressor 120 to be operated from a domestic single phase electrical supply.

Reducing the motor speed as the piston 18 approaches TDC and BDC has the additional advantage slowing the speed of movement of the seals 46, 52, 54, 56 at their highest pressure loading points, and in so doing reduces seal wear and increases the operational lifetimes of the seals 46, 52, 54, 56. Controlling the motor speed in this way also allows higher gas throughput while pressure loading on the seals 46, 52, 54, 56 is low, thereby maximising the performance when the wear attrition on the seals 46, 52, 54, 56 is least.

The overall average rotational speed of the electric motor is sufficient to deliver an output compressed fluid flow of 2 $m^3$/hour at 200 Bar pressure.

An alternative to operating the electric motor at a variable speed is to use an eccentric cam or a non-circular cam. This would result in the effective mechanical length of the connecting rod 124 varying over a piston cycle such that the maximum torque and speed at any point around the cam is limited by the cam profile (the torque changes according to the ratio of the cam radius to the length of the connecting rod 124) whilst the cam is driven at constant speed.

Figure 7:
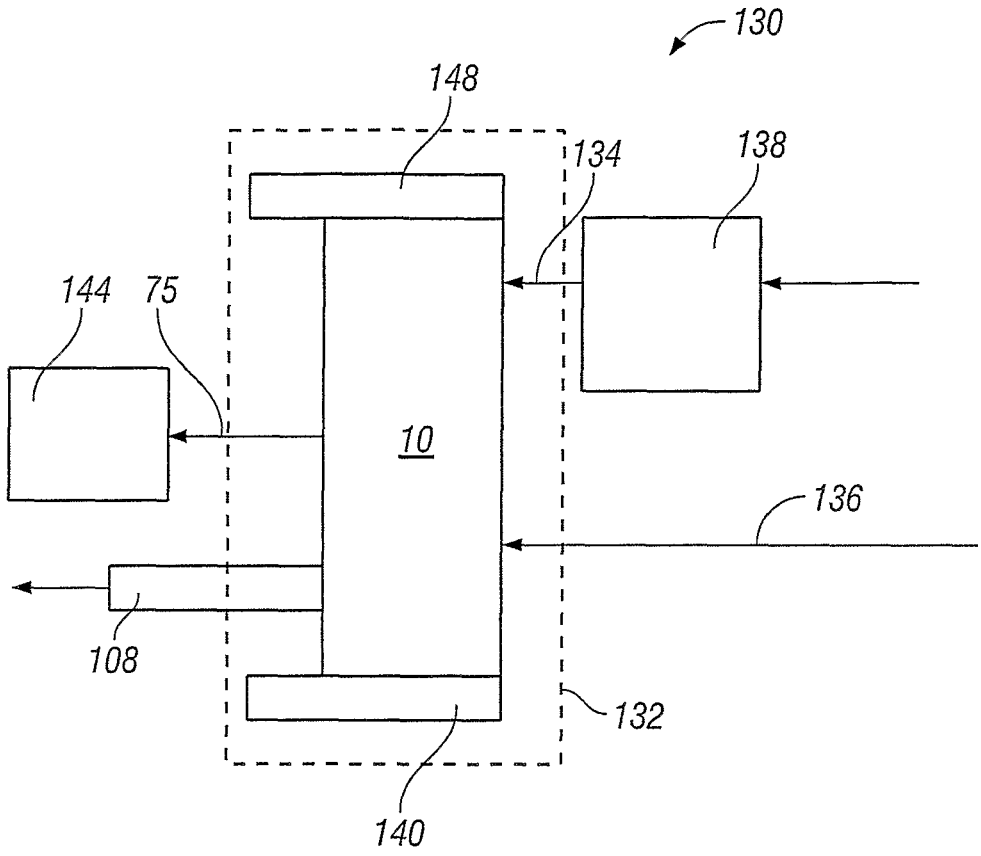
FIG. 7 is a schematic representation of motor vehicle compressed natural gas refuelling apparatus according to a third embodiment of the invention.

FIG. 7 shows a motor vehicle compressed natural gas refuelling apparatus 130 according to a third embodiment of the invention. The apparatus comprises a fluid compressor 10 according to the first embodiment of the invention (although it will be appreciated that the fluid compressor 120 of the second embodiment could equally well be used), a compressor housing 132, a gas inlet conduit 134, and an electrical power supply cable 136.

The gas inlet conduit 134 is coupled at one end to a fluid inlet of the fluid compressor 10 and is provided with a connector at its other end for connection to a natural gas supply, in this example a domestic gas supply meter 138.

The compressor housing 132 is provided with an air inlet 140 and an air outlet 142, by which the apparatus 130 can be aircooled.

The compressed gas delivery conduit 75 is coupled, via its breakaway connector 114, to the compressed gas storage vessel 144 of a motor vehicle, such as a car.

Various modifications may be made without departing from the scope of the present invention. For example, it will be appreciated that the fluid compressors 10, 120 may be used to compress gas to a different pressure to that described, with corresponding changes in the gas flow rate. For example, if the gas is to be compressed to 20 Barg, the gas flow rate can typically be increased to 3.337 $m^3$/hour as a result of the reduction in the maximum torque required to drive the piston 18.

The fluid compressors may have a different number of compression chambers to those described, and in particular may have two compression chambers (being the first and second compression chambers of the above described examples) or may have four compression chambers. The fourth compression chamber comprising the volume of the second stator chamber between the outer surface of the inner stator wall and the inner surface of the piston sleeve. It will be appreciated that additional inlet and outlet valves will be required for additional compression chambers, together with additional intercooling conduits.

Although the fluid compressors have been described in operation compressing natural gas, it will be appreciated that other gases such as nitrogen, hydrogen and air may also be compressed, as may non gaseous fluids.

The described embodiments provide various advantages as follows. Since the fluid compressors are oil-less the compressed gas is not contaminated with by an lubricants.

The nominal gas throughput of the fluid compressor 10 is 2 $m^3$/hour at full load, is achieved with a relatively slow moving, piston action, typically having a duration of 2.9 seconds per complete piston cycle (TDC to BDC to TDC). Compared to known fluid compressors designed to perform this type of duty, the distance travelled by the seals is less than $1/20^{th}$ of the distance travelled by seals in conventional compressors, and hence their operational lifetimes are significantly longer meaning the fluid compressors can operate longer between seal replacements. Furthermore, using a variable speed motor driven crank shaft to drive the piston further improves the longevity of the seals by slowing their speed at the point of greatest pressure loading.

The gas flow rate is determined by the swept volume of the third compression chamber, its volumetric efficiency and speed of operation (stroke time), whilst the relative sizes of swept volume determines the gas compression ratio for each stage.

The low speed of operation of the actuation means allows the hydraulic ram and the electric motor to be powered by a single phase electric power supply, enabling the fluid compressors to be used in a domestic environment.

The recovery vessel enables off-loading gas to be recycled through the compressor rather than being vented to the atmosphere prior to decoupling the delivery conduit.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

The invention claimed is:

1. A fluid compressor comprising:

a first compression chamber of a first volume;

a compressed fluid outlet conduit coupled to the first compression chamber;

a second compression chamber of a second, larger volume extending concentrically around the first compression chamber;

a third compression chamber of a third volume, larger than each of the first volume and the second volume, the third compression chamber extending concentrically around the first compression chamber and being part co-linear with the second compression chamber;

a piston mounted for linearly reciprocating movement, the piston comprising a piston sleeve extending concentrically around a central piston rod, a first piston head at a distal end of the piston sleeve movable to compress fluid within the first compression chamber, and a second piston head at a distal end of the piston sleeve separating the second and third compression chambers, the second piston head being movable to compress fluid within the second compression chamber and the third compression chamber;

actuation means operable to drive the piston, whereby as the piston is driven in a first linear direction fluid in the first and third compression chambers is compressed and compressed fluid from the third compression chamber is delivered to the second compression chamber, and, simultaneously, any gas in the first compression chamber is forced out of the first compression chamber and through the compressed fluid outlet conduit into an external gas storage vessel, and whereby as the piston is driven in the opposite direction fluid enters the third compression chamber, and any fluid in the second compression chamber is compressed and any fluid from the second compression chamber is forced out of the second compression chamber, and delivered into the first compression chamber; and a stator defining a second stator chamber extending concentrically around a first stator chamber, the piston and the stator together defining the fluid compression chambers, the first stator chamber forming the first fluid compression chamber and the second and third compression chambers comprise parts of the second stator chamber defined by the piston and one or more walls of the second stator chamber, wherein the second fluid compression chamber comprises the volume of the second stator chamber between an outermost surface of the piston sleeve, an external wall of the second stator chamber and part of one side of the second piston head, the third fluid compression chamber comprising the volume of the second stator chamber between the other side of the second piston head and the walls of the second stator chamber.

2. A fluid compressor as claimed in claim 1, wherein the ratio of the volumes of the compression chambers is selected to provide for substantially the same amount of fluid compression within each compression chamber.

3. A fluid compressor as claimed in claim 1, wherein each compression chamber is provided with an inlet valve and an outlet valve, the outlet valve of the first compression chamber being coupled to the inlet valve of a subsequent compression chamber by a respective inter-cooling conduit.

4. A fluid compressor as claimed in claim 1, wherein the actuation means comprises a hydraulic actuator coupled to the piston.

5. A fluid compressor as claimed in claim 1, wherein the actuation means comprises a crank shaft driven by a cam coupled to an electric motor.

6. A fluid compressor as claimed in claim 5, wherein the electric motor has a variable drive speed or the cam is an eccentric cam or a cam having a non-circular profile.

7. A fluid compressor as claimed in claim 1, wherein the fluid compressor further comprises fluid metering means operable to measure the volume of fluid input into the fluid compressor.

8. A fluid compressor as claimed in claim 1, wherein no part of the compressor which comes into contact with fluid being processed by the fluid compressor has any lubricants, thereby making the fluid compressor oil-less on its fluid side.

9. A fluid compressor as claimed in claim 1, wherein the fluid comprises a gas.

10. The fluid compressor as claimed in claim 1, further comprising:

a gas inlet conduit coupled at one end to a fluid inlet of the fluid compressor and having connection means at its other end for connection to a natural gas supply; and electrical power connection means coupled to the actuation means.

11. A fluid compressor comprising:

a first compression chamber of a first volume;

a compressed fluid outlet conduit coupled to the first compression chamber;

a second compression chamber of a second, larger volume extending concentrically around the first compression chamber;

a third compression chamber of a third volume, larger than each of the first volume and the second volume, the third compression chamber extending concentrically around the first compression chamber and being part co-linear with the second compression chamber;

a piston mounted for linearly reciprocating movement, the piston comprising a first piston head movable to compress fluid within the first compression chamber, and a second piston head separating the second and third compression chambers, the second piston head being movable to compress fluid within the second compression chamber and the third compression chamber;

actuation means operable to drive the piston, whereby as the piston is driven in a first linear direction fluid in the first and third compression chambers is compressed and compressed fluid from the third compression chamber is delivered to the second compression chamber, and, simultaneously, any gas in the first compression chamber is forced out of the first compression chamber and through the compressed fluid outlet conduit into an external gas storage vessel, and whereby as the piston is driven in the opposite direction fluid enters the third compression chamber, and any fluid in the second compression chamber is compressed and any fluid from the second compression chamber is forced out of the second compression chamber, and delivered into the first compression chamber, and wherein the fluid compressor further comprises a fluid recovery vessel coupled between the compressed fluid outlet conduit and the first compression chamber, the fluid outlet conduit being arranged to be selectively coupled to and decoupled from a receiving compressed fluid storage vessel, and the fluid recovery vessel being arranged to receive compressed fluid present within the outlet conduit prior to decoupling the outlet conduit from the receiving compressed fluid storage vessel, thereby lowering the fluid pressure within the delivery conduit prior to decoupling.

12. A fluid compressor comprising:

a first compression chamber of a first volume;

a compressed fluid outlet conduit coupled to the first compression chamber;

a second compression chamber of a second, larger volume extending concentrically around the first compression chamber;

a third compression chamber of a third volume, larger than each of the first volume and the second volume, the third compression chamber extending concentrically around the first compression chamber and being part co-linear with the second compression chamber;

a piston mounted for linearly reciprocating movement, the piston comprising a first piston head movable to compress fluid within the first compression chamber, and a second piston head separating the second and third compression chambers, the second piston head being movable to compress fluid within the second compression chamber and the third compression chamber;

actuation means operable to drive the piston, whereby as the piston is driven in a first linear direction fluid in the first and third compression chambers is compressed and compressed fluid from the third compression chamber is delivered to the second compression chamber, and, simultaneously, any gas in the first compression chamber is forced out of the first compression chamber and through the compressed fluid outlet conduit into an external gas storage vessel, and whereby as the piston is driven in the opposite direction fluid enters the third compression chamber, and any fluid in the second compression chamber is compressed and any fluid from the second compression chamber is forced out of the second compression chamber, and delivered into the first compression chamber, wherein the actuation means comprises a crank shaft driven by a cam coupled to an electric motor, wherein the electric motor has a variable drive speed or the cam is an eccentric cam or a cam having a non-circular profile; and a metering means comprising piston cycle counting means, a fluid temperature sensor, a fluid pressure sensor, a non-transitory tangible computer readable storage medium operable to store the value of the volumetric capacity of the compression chamber into which fluid to be compressed is delivered from an external fluid supply, and processor means operable to convert the number of piston cycles into the volume of fluid delivered from the external fluid supply to the fluid compressor, wherein the number of piston cycles corresponds to the number of times that the compression chamber is filled with fluid from the external supply.

13. A fluid compressor as claimed in claim 12, wherein the processor means is operable to write the volume of fluid delivered to the fluid compressor during a single operation of the fluid compressor to the non-transitory tangible computer readable storage medium, and is further operable to add together the volumes of fluid delivered to the fluid compressor during a plurality of operations of the fluid compressor.

14. A fluid compressor comprising:

a first compression chamber of a first volume;

a compressed fluid outlet conduit coupled to the first compression chamber;

a second compression chamber of a second, larger volume extending concentrically with the first compression chamber;

a third compression chamber of a third volume, larger than each of the first volume and the second volume, the third compression chamber extending concentrically with the first compression chamber and being part co-linear with the second compression chamber;

a piston mounted for linearly reciprocating movement, the piston comprising a first piston head at the distal end of the piston movable to compress fluid within the first compression chamber and a second piston head separating the second and third compression chambers, the second piston head being movable to compress fluid within the second compression chamber and the third compression chamber;

actuation means operable to drive the piston, whereby as the piston is driven in a first linear direction fluid in the first and third compression chambers is compressed, and compressed fluid from the third compression chamber is delivered to the second compression chamber, and whereby as the piston is driven in the opposite direction fluid enters the third compression chamber and fluid in the second compression chamber is compressed and compressed fluid from the second compression chamber is delivered to the first compression chamber; and a stator defining a second stator chamber extending concentrically with a first stator chamber, the piston and the stator together defining the fluid compression chambers, the first stator chamber forming the first fluid compression chamber and the second and third compression chambers comprise parts of the second stator chamber defined by the piston and one or more walls of the second stator chamber, wherein the second fluid compression chamber comprises the volume of the second stator chamber between an outermost surface of the piston, an external wall of the second stator chamber and part of one side of the second piston head, the third fluid compression chamber comprising the volume of the second stator chamber between the other side of the second piston head and the walls of the second stator chamber.

15. A fluid compressor as claimed in claim 14, wherein the ratio of the volumes of the compression chambers is selected to provide for substantially the same amount of fluid compression within each compression chamber.

16. A fluid compressor as claimed in claim 14, wherein each compression chamber is provided with an inlet valve and an outlet valve, the outlet valve of the first compression chamber being coupled to the inlet valve of a subsequent compression chamber by a respective inter-cooling conduit.

17. A fluid compressor as claimed in claim 14, wherein the fluid compressor further comprises a fluid recovery vessel coupled between the compressed fluid outlet conduit and the first compression chamber, the fluid outlet conduit being arranged to be selectively coupled to and decoupled from the receiving compressed fluid storage vessel, and the fluid recovery vessel being arranged to receive compressed fluid present within the outlet conduit prior to decoupling the outlet conduit from the receiving compressed fluid storage vessel, to thereby lower the fluid pressure within the delivery conduit prior to decoupling.

18. A fluid compressor as claimed in claim 14, wherein the actuation means comprises a hydraulic actuator coupled to the piston.

19. A fluid compressor as claimed in claim 14, wherein the actuation means comprises a crank shaft driven by a cam coupled to an electric motor.

20. A fluid compressor as claimed in claim 19, wherein the electric motor has a variable drive speed or the cam is an eccentric cam or a cam having a non-circular profile.

21. A fluid compressor as claimed in claim 14, wherein the fluid compressor further comprises fluid metering means operable to measure the volume of fluid input into the fluid compressor.

22. A fluid compressor as claimed in claim 21, wherein the fluid metering means comprises piston cycle counting means, a fluid temperature sensor, a fluid pressure sensor, a non-transitory tangible computer readable storage medium operable to store the value of the volumetric capacity of the compression chamber into which fluid to be compressed is delivered from an external fluid supply, and processor means operable to convert the number of piston cycles into the volume of fluid delivered from the external fluid supply to the fluid compressor, wherein the number of piston cycles corresponds to the number of times that the compression chamber is filled with fluid from the external supply.

23. A fluid compressor as claimed in claim 22, wherein the processor means is operable to write the volume of fluid delivered to the fluid compressor during a single operation of the fluid compressor to the a non-transitory tangible computer readable storage medium, and is further operable to add together the volumes of fluid delivered to the fluid compressor during a plurality of operations of the fluid compressor.

24. A motor vehicle compressed natural gas refuelling apparatus comprising:

a compressor housing comprising:

a first compression chamber of a first volume;

a compressed fluid outlet conduit coupled to the first compression chamber;

a second compression chamber of a second, larger volume extending concentrically with the first compression chamber;

a third compression chamber of a third volume, larger than each of the first volume and the second volume, the third compression chamber extending concentrically with the first compression chamber and being part co-linear with the second compression chamber;

a piston mounted for linearly reciprocating movement, the piston comprising a first piston head at the distal end of the piston movable to compress fluid within the first compression chamber and a second piston head separating the second and third compression chambers, the second piston head being movable to compress fluid within the second compression chamber and the third compression chamber;

actuation means operable to drive the piston, whereby as the piston is driven in a first linear direction fluid in the first and third compression chambers is compressed, and compressed fluid from the third compression chamber is delivered to the second compression chamber, and whereby as the piston is driven in the opposite direction fluid enters the third compression chamber and fluid in the second compression chamber is compressed and compressed fluid from the second compression chamber is delivered to the first compression chamber; and a stator defining a second stator chamber extending concentrically with a first stator chamber, the piston and the stator together defining the fluid compression chambers, the first stator chamber forming the first fluid compression chamber and the second and third compression chambers comprise parts of the second stator chamber defined by the piston and one or more walls of the second stator chamber, wherein the second fluid compression chamber comprises the volume of the second stator chamber between an outermost surface of the piston, an external wall of the second stator chamber and part of one side of the second piston head, the third fluid compression chamber comprising the volume of the second stator chamber between the other side of the second piston head and the walls of the second stator chamber;

a gas inlet conduit coupled at one end to a fluid inlet of the fluid compressor and having connection means at its other end for connection to a natural gas supply; and electrical power connection means coupled to the actuation means.

* * * * *